US005279195A

United States Patent [19]

Breton

[11] Patent Number: 5,279,195

[45] Date of Patent: Jan. 18, 1994

[54] APPARATUS FOR CONTINUOUSLY TRANSPORTING, SEPARATING, AND CHANGING THE PATH OF WEBS

[75] Inventor: Richard E. Breton, Rochester, N.H.

[73] Assignee: Heidelberg Harris, Inc., Dover, N.H.

[21] Appl. No.: 845,277

[22] Filed: Mar. 3, 1992

[51] Int. Cl.[5] ..... B26D 7/06; B26D 1/38; B26D 7/18

[52] U.S. Cl. ..... 83/72; 83/102; 83/106; 83/156; 83/163; 83/365; 83/370; 83/566; 83/610

[58] Field of Search ..... 83/23, 102, 105, 106, 83/156, 365, 107, 610, 72, 147, 163, 370, 566

[56] References Cited

U.S. PATENT DOCUMENTS

| | | | |
|---|---|---|---|
| 1,836,363 | 12/1931 | Drake | 83/106 |
| 2,751,981 | 6/1956 | Hawkins | 83/107 X |
| 3,422,713 | 1/1969 | Groepler | 83/156 |
| 3,616,770 | 11/1971 | Blyther et al. | 83/365 X |
| 3,756,527 | 9/1973 | Collins et al. | 83/102 X |
| 3,844,189 | 10/1974 | Jardine | 83/102 X |
| 3,854,357 | 12/1974 | Kron | 83/106 X |

FOREIGN PATENT DOCUMENTS

| | | | |
|---|---|---|---|
| 2056958 | 5/1972 | Fed. Rep. of Germany | 83/105 |
| 1441993 | 7/1976 | United Kingdom | 83/106 |

*Primary Examiner*—Hien H. Phan
*Assistant Examiner*—Clark F. Dexter
*Attorney, Agent, or Firm*—Kenyon & Kenyon

[57] ABSTRACT

An apparatus for continuously transporting, separating, and changing the path of webs in machines for processing webs prior to further processing are disclosed. A web consisting of at least one ribbon of material is conveyed by a pair of nip rollers arranged in a first transport path. When it is desired to separate and convey the web, for example when the web is of insufficient quality, a separating flap pivotally mounted on a first rotary axis located above the first transport path pivots downward cutting and directing the web to a second transport path. A blade flap pivotally mounted on a second rotary axis located below the first transport path opens and closes the transport path to the web. When the blade flap is in the closed position it bridges a gap between a lower guide and a guide section to allow the conveyance of a web through the first transport path.

12 Claims, 2 Drawing Sheets

APPARATUS FOR CONTINUOUSLY TRANSPORTING, SEPARATING, AND CHANGING THE PATH OF WEBS

FIELD OF THE INVENTION

The present invention relates to an apparatus for continuously transporting, separating, and changing the path of webs in machines for processing webs prior to further processing.

BACKGROUND INFORMATION

U.S. Pat. No. 3,866,902 is directed to a device for selecting and separating defective printed products from a stream of printed products being conveyed through the device. A cam controlled roller lever having two arms serves to unlock a lever which activates a deflecting flap. Setting the regulating distances of such a roller lever and deflecting flap, however, is time consuming. Moreover, processing of webs passing through is not possible with such a device.

British Patent GB 2 061 235 is directed to a deflection arrangement for a stream of overlapping printed products. In this device a flap, which is arranged in a gap between conveyor belts, can be rotated up and down. In the up position, the flap deflects individual printed sheets onto a transport path situated below the flap. This device, however, only operates to deflect printed sheets.

OBJECTS AND SUMMARY OF INVENTION

It is an object of the present invention to provide a simple and economical apparatus and method for diverting webs, having quality deficiencies, out of machines for processing the webs, prior to their further processing.

One advantage of the present invention is that if during the start-up of the machine which processes webs the quality of a web is insufficient, it is diverted out of the machine so as to avoid waste finishing. Moreover, during disturbances in the further processing in printing presses, for example, the production run conditions in the printing units can be maintained, while the disturbance in the unit for further processing can be removed. If a printed web is still of insufficient quality or one of several strands is still an incomplete web, it can be diverted out of the machine, for example, without applying to a folding apparatus a misprint or incomplete web.

In a preferred embodiment of the present invention a blade flap in closed position below a first transport path bridges a gap between a lower guidance and a guiding section. The blade edge of a separating flap as well as a separating blade of the blade flap work together with an anvil of a guide tongue. This has the advantage of preventing the conveyance of a web being qualitatively insufficient into a device having been arranged thereafter for further processing and of leading this web towards a second transport path until the quality of the web allows further processing. The blade flap, separating the carried off portion of the web, closes the gap which is formed in the first transport path through the swinging of the blade flap and conveying of the sufficient quality web. Another advantage of the present invention is that when the separating flap is swung downwardly, the beginning of a web is conveyed through transport rollers; one of which can be pivoted into and driven in a guide tongue. This prevents a back draft of the web from occurring.

Another advantage of the invention is that at the contact of the separation blade with the anvil, the separating flap opens the first transport path. This automatically assures the transport of the web for further processing, without the need for rearrangement.

Additionally, in a preferred embodiment of the present invention the activation of the separating flap and the blade flap as well as the pivoting of the transport roller into and out of the guide tongue occurs with pressure applied thereto. Moreover, an electro-magnetical activation as well as an activation involving an electric motor is possible.

Another advantage of the present invention is that the activation of the separating flap and blade flap is controlled by a web thickness controlling device disposed in the first transport path. This enables operation of the blade flap and separating flap, without the need for operator assistance.

Another advantage of the present invention is that after the blade flap is closed the drive of the transport rollers is turned off, which is timely delayed by a web sensor inserted in the guide tongue above the transport rollers, so that no waste of webs can accumulate below the closed blade flap.

The present invention provides an apparatus for continuously transporting, separating, and changing the path of webs in machines for processing webs prior to further processing comprising a means for receiving and transporting a web into a first transport path, a first means for cutting the web traveling along the first transport path producing a first trailing edge and a first leading edge, a first guide means associated with the first cutting means for directing the first leading edge into a second transport path, and a second means for cutting the web traveling along the second transport path producing a second trailing edge and a second leading edge, and a second guide means associated with the second cutting means for directing the second leading edge into the first transport path. Preferably, the first means for cutting the web and the second means for cutting the web are blades, and the first guide means and second guide means are surfaces of the blades.

The present invention also provides a method for continuously transporting, separating, and changing the path of webs in machine for processing webs prior to further processing comprising the steps of: receiving and transporting a web into a first transport path, cutting the web traveling along the first transport path producing a first trailing edge and a first leading edge, guiding the first leading edge into a second transport path, cutting the web traveling along the second transport path, producing a second trailing edge and a second leading edge, and directing the second leading edge into the first transport path.

Other advantages and characteristics of the present invention will become apparent in view of the drawings and description that follows.

DETAILED DESCRIPTION

Figure 1:
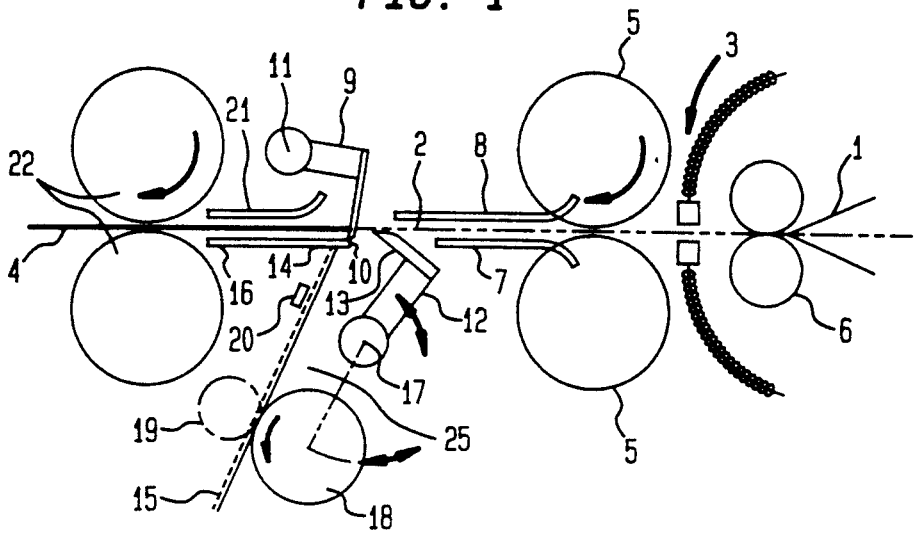
FIG. 1 shows the position of separation and blade flaps when activating the machine.

A web 4 is transported from a fold former 1, to a device for the separation and conveyance of webs, as shown in FIG. 1. After exiting the fold former 1, the web 4 being guided in a first transport path 2 is engaged by a draw roller 6 which continues to transport the web 4 through a web thickness controlling device 3. The web thickness controlling device 3 measures the thickness of the web 4 which can vary especially during the start-up phase of a printing press when the web ribbons forming a web arrive at different points in time in the superstructure, and therefore also in the folder former 1. After passing the web thickness controlling device 3, the web 4 is engaged by a transport means preferably a nip roller pair 5 and conveyed into a channel formed by a lower guide 7 and an upper guide 8. The further conveyance of the web 4, in the first transport path 2, is obstructed by a separating flap 9 illustrated in downwardly pivoting position. A movable blade flap 12 rotates clockwise around a pivoting axis 17 and opens a second transport path 25 defined by a guide tongue 15. Simultaneously, transport roller 18, which can also be rotated around the pivoting axis 17, is adjusted to a guide tongue 15, where it cooperates with a pull roller 19. To avoid a paper jam, the transport roller 18 can be rotated with a somewhat higher speed than the nip roller pair 5, while the pull roller 19 is not being driven.

The blade flap 12, movable around the pivoting axis 17, carries at its end facing the guide tongue 15 a separating blade 13, which cooperates with an edge of the guide tongue 15 that has been formed as an anvil 14. The separating flap 9, on its front end, is also provided with a blade edge 10, in order to enable the separation of a web to be conveyed. As seen in the direction of conveyance of the web 4, the continuation of the guide tongue 15 forms a guiding section 16 which forms the lower limitation of the first transport path 2. The upper limitation of the first transport path 2 is formed by an upper guide 21, the end of which facing the separating flap 9 is slightly bent open in order to ease the intake of the web 4. Behind the guiding section 16 and the upper guide 21 a second pair of nip rollers 22 join, making possible the further conveyance of a web 4.

Figure 2:
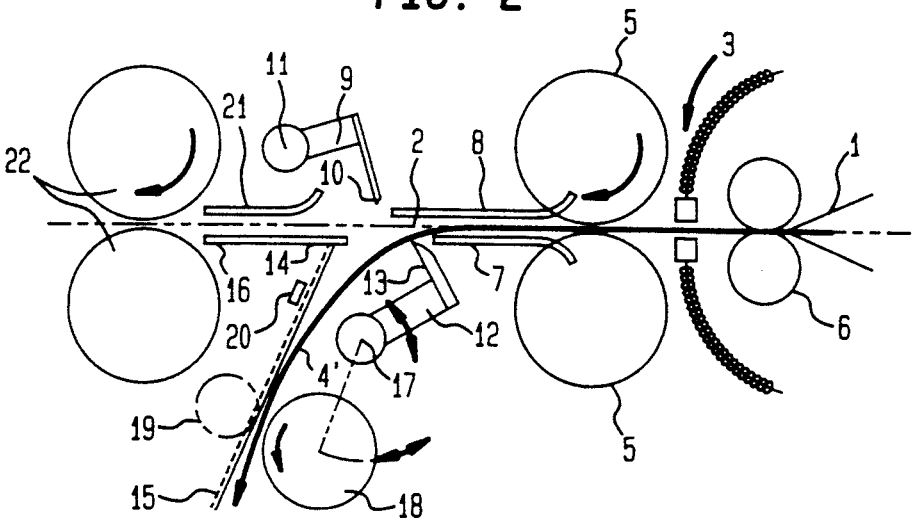
FIG. 2 shows the diversion of an incomplete web which does not meet the quality requirements.

FIG. 2 shows the diversion of an incompletely gathered or otherwise not sufficient quality web 4'. The web 4' transported in the first transport path 2 along the lower guide 7 and past the blade flap 12 being swung backwards is conveyed on a guide tongue 15 located in a second transport path 25. Driven transport roller 18 cooperating with pull roller 19 being disposed in the guide tongue 15 convey the web 4' out of the device, which is separating and conveying webs. A web sensor 20 which can be arranged in the guide tongue 15 above the pull roller 19 monitors whether the web 4' is conveyed between guide tongue 15, pull roller 19 and the transport roller 18. As long as this is the case, the transport roller 18 continues to be driven. The web sensor 20 can for instance be built as a photoelectric sensor. After the web 4' is conveyed between the guide tongue 15 and the transport roller 18, the separating flap 9 pivots in its upper setting position and opens the first transport path 2.

Figure 3:
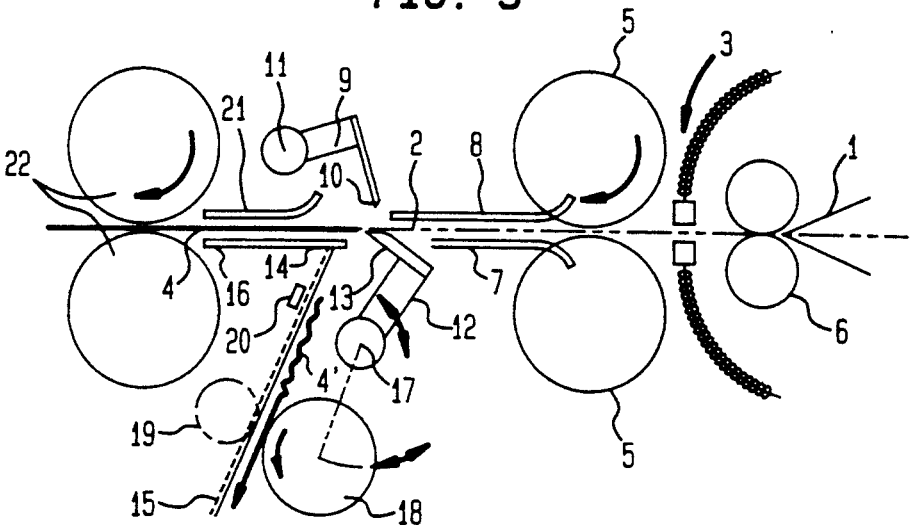
FIG. 3 shows the separation of a web as well as the removal of the separated section of the web.

FIG. 3 shows the separation of the web 4' and the removal of the separated section. Once the web thickness control device 3 recognizes the presence of a web consisting of all web ribbons completely gathered, then the blade flap 12 swings counter clockwise, and the web 4' is cut by the engagement of the separating blade 13 with the anvil 14. The existence of the cut portion of the web 4' is recognized by the web sensor 20, which, being time delayed, switches off the drive of the transport roller 18 after the web section is conveyed out of the chamber being formed by the guide tongue 15 and the blade flap 12. Only then is the transport roller 18 pivoted out of the guide tongue 15 and pull roller 19 about axis 17. This arrangement readies the second transport path for receipt of the next web to be diverted out of the machine.

Whether a complete web corresponding to the quality requirements has reached the device for separating and conveying webs can also be determined, aside from the web thickness control device 3, by the operators, who, at any time, can take the necessary steps for the separation and removal of the web. After the separation of a portion of the web 4, the second transport path 25 is closed by the counter-clockwise pivoting of the blade flap 12. The newly formed leading edge of the web 4 is then conveyed into the channel being formed between the upper guide 21 and the guiding section 16 and is then gripped by a pair of nip rollers 22 and conveyed into a unit for further processing.

If a mistake occurs in the unit for further processing, the separating flap 9 and the blade flap 12 can immediately be activated. The blade flap 12 swings clockwise around the pivoting axis. This opens the second transport path 25 to the web along the guide tongue 15 in the direction of the transport roller 18. Thereafter, the separation flap 9 rotates around the rotary axis 11. The blade edge 10 impacts onto the anvil 14 and closes the first transport path 2, as shown in FIG. 1. The newly formed leading edge of the web 4 is conveyed in the direction of the guide tongue 15 and conveyed through the transport roller 18.

Figure 4:
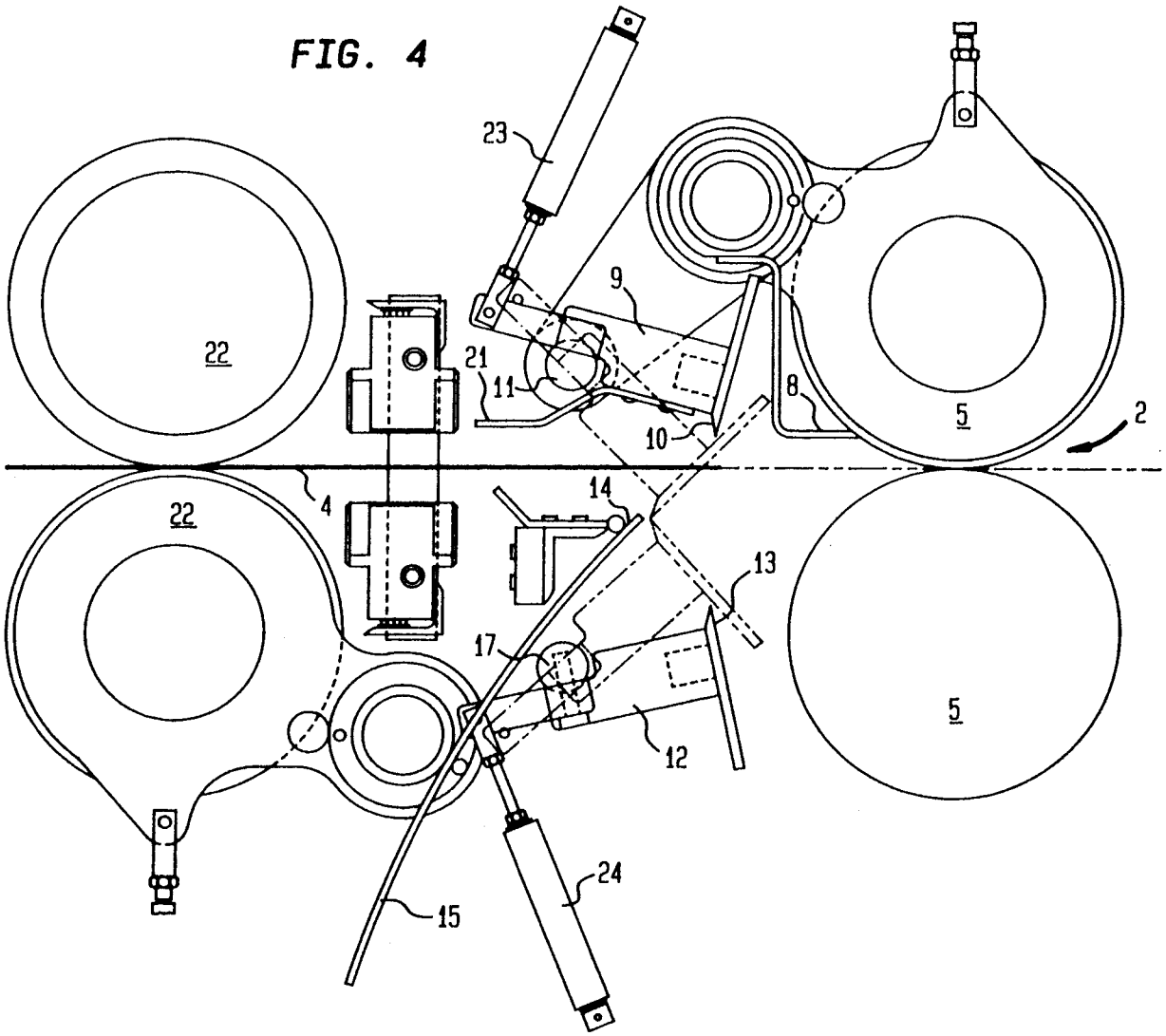
FIG. 4 shows another embodiment of the device according to the invention.

In FIG. 4 another preferred embodiment of the present invention is shown. Unlike the embodiment in FIGS. 1 to 3, which reveal the function of the device for separation and conveyance, the embodiment shown in FIG. 4 is a slightly different design. The web 4 being guided in a first transport path 2 is transported by means of a nip roller pair 5 and a nip roller pair 22. A pivoting axis 17 and a blade flap 12 mounted thereto are located in the area between the lower nip rollers 5 and 22. A separating blade 13 is fastened via conventional screwing means to the top of the blade flap 12. The blade edge of the separating blade 13 cooperates with the anvil 14 of the guide tongue 15. The pivoting movement of the blade flap 12 around the pivoting axis 17 is accomplished via actuation means 24, for instance a pneumatic cylinder In contrast to the embodiment in FIGS. 1 to 3, the anvil 14 is located a distance below the first transport path 2. As the blade edge 10 of the upper separating flap 9 engages the web 4, the web 4 is pushed against the anvil 14 and cut. The separating flap 9 which is located above the first transport path 2 is pivoted around the rotary axis 11 via actuation means 23. On both sides of the separating flap 9 there are provided upper guides 8 and 21. In comparison to the embodiment in FIGS. 1 to 3, these upper guides 8 and 21 show a different shape. The further transportation of the web 4 across the device for separation and conveyance according to the invention into a further processing unit—for instance a folding apparatus—is maintained through the nip roller pair 22.

I claim:

1. An apparatus for continuously transporting, separating, and changing the path of webs in machines for processing webs prior to further processing comprising:

a means for receiving and transporting a web into a first and a second transport path;

a first blade, having a cutting edge, pivotally mounted on a first rotary axis located above the first transport path for cutting the web, producing a first trailing edge and a first leading edge, and directing the first leading edge into the second transport path located below the first transport path; and a second blade, having a cutting edge, pivotally mounted on a second rotary axis located below the first transport path for cutting the web traveling along the second transport path, producing a second trailing edge and a second leading edge, and directing the second leading edge into the first transport path.

2. The apparatus according to claim 1, wherein the means for receiving and transporting the web is a pair of nip rollers.

3. The apparatus according to claim 2, further comprising an anvil of a guide tongue cooperating with the cutting edges of the first and second blades for cutting the web.

4. The apparatus according to claim 3, wherein the anvil is disposed adjacent to the first transport path.

5. The apparatus according to claim 3, wherein the anvil is disposed below the first transport path.

6. The apparatus according to claim 3, further comprising at least one transport roller being pivotable into and out of the guide tongue, said at least one transport roller being pivoted into and driven in the guide tongue for transporting the web along the second transport path.

7. The apparatus according to claim 6, further comprising at least one pull roller disposed in the guide tongue cooperating with the at least one transport roller.

8. The apparatus according to claim 6, further comprising a web thickness controlling device disposed in the first transport path which controls the activation of the first and second blades.

9. The apparatus according to claim 6, further comprising a web sensor disposed in the guide tongue.

10. The apparatus according to claim 3, wherein during contact of the first blade with the anvil the first blade bridges a gap between a lower guide and a guide section located in the first transport path.

11. The apparatus according to claim 3, wherein during contact of the second blade with the anvil the first blade opens the first transport path to the second leading edge.

12. The apparatus according to claim 1, wherein the pivoting movement of the first blade and the second blade around their respective rotating axes is accomplished by separate actuation means.

* * * * *